US009523557B2

(12) United States Patent
Sharron et al.

(10) Patent No.: US 9,523,557 B2
(45) Date of Patent: Dec. 20, 2016

(54) ACCESSORY ATTACHMENT DEVICE FOR A FIREARM

(71) Applicants: Matthew A. Sharron, Seymour, CT (US); Andrew Visinski, Seymour, CT (US)

(72) Inventors: Matthew A. Sharron, Seymour, CT (US); Andrew Visinski, Seymour, CT (US)

( * ) Notice: Subject to any disclaimer, the term of this patent is extended or adjusted under 35 U.S.C. 154(b) by 0 days.

(21) Appl. No.: 14/662,342

(22) Filed: Mar. 19, 2015

(65) Prior Publication Data

US 2016/0102946 A1 Apr. 14, 2016

Related U.S. Application Data

(60) Provisional application No. 62/067,612, filed on Oct. 23, 2014, provisional application No. 62/062,441, filed on Oct. 10, 2014.

(51) Int. Cl.
*F41C 23/16* (2006.01)
*F41G 11/00* (2006.01)

(52) U.S. Cl.
CPC ..... *F41G 11/003* (2013.01)

(58) Field of Classification Search
CPC ..... F41C 23/16; F41C 23/02; F41G 11/003; F41A 23/08; F41A 23/10
USPC ..... 42/90, 124–128, 72, 94, 71.01
See application file for complete search history.

(56) References Cited

U.S. PATENT DOCUMENTS

| | | | | |
|---|---|---|---|---|
| 7,111,424 | B1 * | 9/2006 | Moody | F41A 23/08 248/171 |
| 7,797,875 | B1 * | 9/2010 | Carrier | F41G 11/003 211/85.7 |
| 7,891,126 | B2 * | 2/2011 | Moody | F41A 23/08 248/171 |
| 8,156,678 | B2 * | 4/2012 | Hoel | F41G 11/003 42/124 |
| 8,393,104 | B1 * | 3/2013 | Moody | F41C 23/14 42/71.01 |
| 8,505,229 | B2 * | 8/2013 | Savoy | F41G 11/003 42/128 |
| 8,567,301 | B1 * | 10/2013 | Sharron | F41A 3/72 89/1.4 |
| 9,239,209 | B2 * | 1/2016 | Mayberry | F41G 11/005 |
| 9,239,210 | B2 * | 1/2016 | Mayberry | F41C 23/16 |
| 2005/0188597 | A1 * | 9/2005 | Keng | F41A 23/08 42/94 |
| 2006/0277809 | A1 * | 12/2006 | Moody | F41A 23/08 42/72 |
| 2010/0107467 | A1 * | 5/2010 | Samson | F41G 11/003 42/127 |
| 2011/0047850 | A1 * | 3/2011 | Rievley | F41C 23/16 42/72 |
| 2011/0099873 | A1 * | 5/2011 | Bentley | F41C 23/16 42/71.01 |

(Continued)

*Primary Examiner* — Michael David
(74) *Attorney, Agent, or Firm* — Buckingham, Doolittle & Burroughs, LLC

(57) ABSTRACT

An improved device for enabling a user to quickly and securely attach and detach an accessory (e.g., a scope, light, bayonet, etc.) to the Picatinny or tactical rail of a firearm. In a preferred embodiment of the present invention, the device comprises a lower portion, an upper portion and a locking mechanism. The device is relatively inexpensive to manufacture and safe and easy to use.

15 Claims, 8 Drawing Sheets

(56) References Cited

U.S. PATENT DOCUMENTS

| | | | | |
|---|---|---|---|---|
| 2014/0115940 | A1* | 5/2014 | Bonelli | F16M 11/14 42/94 |
| 2014/0237883 | A1* | 8/2014 | Hosz | F41C 27/06 42/105 |
| 2014/0338245 | A1* | 11/2014 | Lanasa | F41C 23/16 42/72 |
| 2015/0020429 | A1* | 1/2015 | Savoy | F41G 11/008 42/111 |

* cited by examiner

ACCESSORY ATTACHMENT DEVICE FOR A FIREARM

CROSS-REFERENCE

This application claims priority from Provisional Patent Application Ser. Nos. 62/062,441 filed Oct. 10, 2014 and 62/067,612 filed Oct. 23, 2014.

FIELD OF THE INVENTION

This invention relates to a quick release attachment for mounting accessories (e.g., a scope, light, bayonet, etc.) on the Picatinny or tactical rail of a firearm.

BACKGROUND

Many individuals and firearm enthusiasts desire to mount one or more interchangeable accessories, such as a scope, light, bayonet and the like, onto their firearms. Historically, this has been accomplished by fixedly mounting the accessory to the Picatinny or tactical rail of the firearm, which is essentially a bracket that can be attached to a firearm and which provides a standard mounting platform for a desired attachment. However, heretofore, the process of mounting such accessories to the Picatinny rail has required the use of external tools, and has been both awkward and time-consuming. Moreover, the inability to timely attach a desired accessory to a firearm, or switch accessories, can be dangerous for the user. For example, in combat, a soldier's inability to quickly attach a bayonet to his firearm could result in death or serious injury to the soldier.

Consequently, there is a long felt need in the art for a device that enables a user to quickly and securely attach/detach an accessory (e.g., a scope, light, bayonet, etc.) to the Picatinny or tactical rail of a firearm without the use of external tools. There is also a long felt need for a device that is capable of being locked/unlocked with a single hand, thereby allowing the user to retain possession of the firearm with his remaining hand. Finally, there is a long felt need for a device that accomplishes all of the forgoing objectives, and that is relatively inexpensive to manufacture and safe and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed herein, in one aspect thereof, is a device for enabling a user to quickly and securely attach/detach an accessory (e.g., a scope, light, bayonet, etc.) to the Picatinny or tactical rail of a firearm. In a preferred embodiment of the present invention, the device comprises a lower portion, an upper portion, and a locking mechanism, wherein said locking mechanism further comprises a handle portion, at least one latch with a spring attached thereto, and at least one lock that is repositionable by the movement of said at least one latch.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
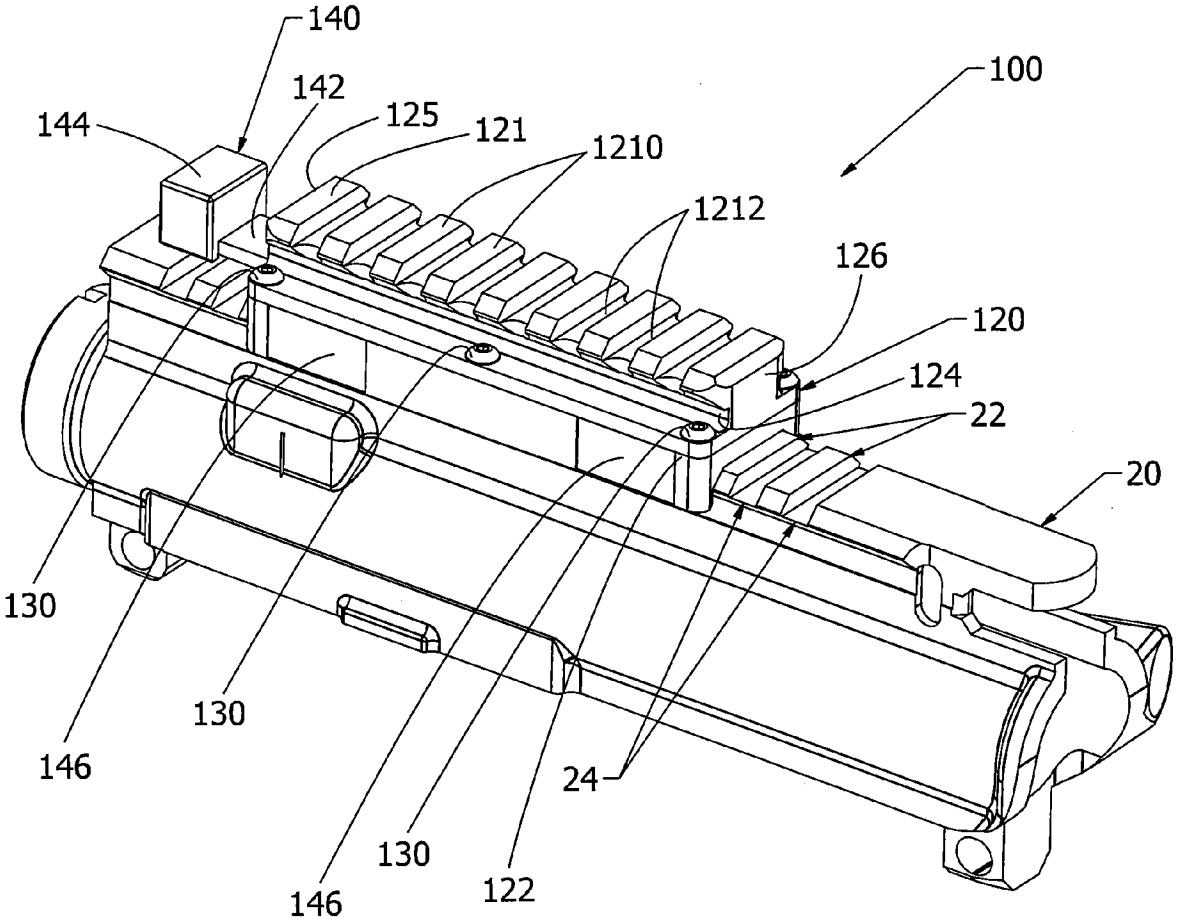
FIG. 1 is a perspective view of the device of the present invention securely attached to a Picatinny rail of a firearm.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details.

Figure 2:
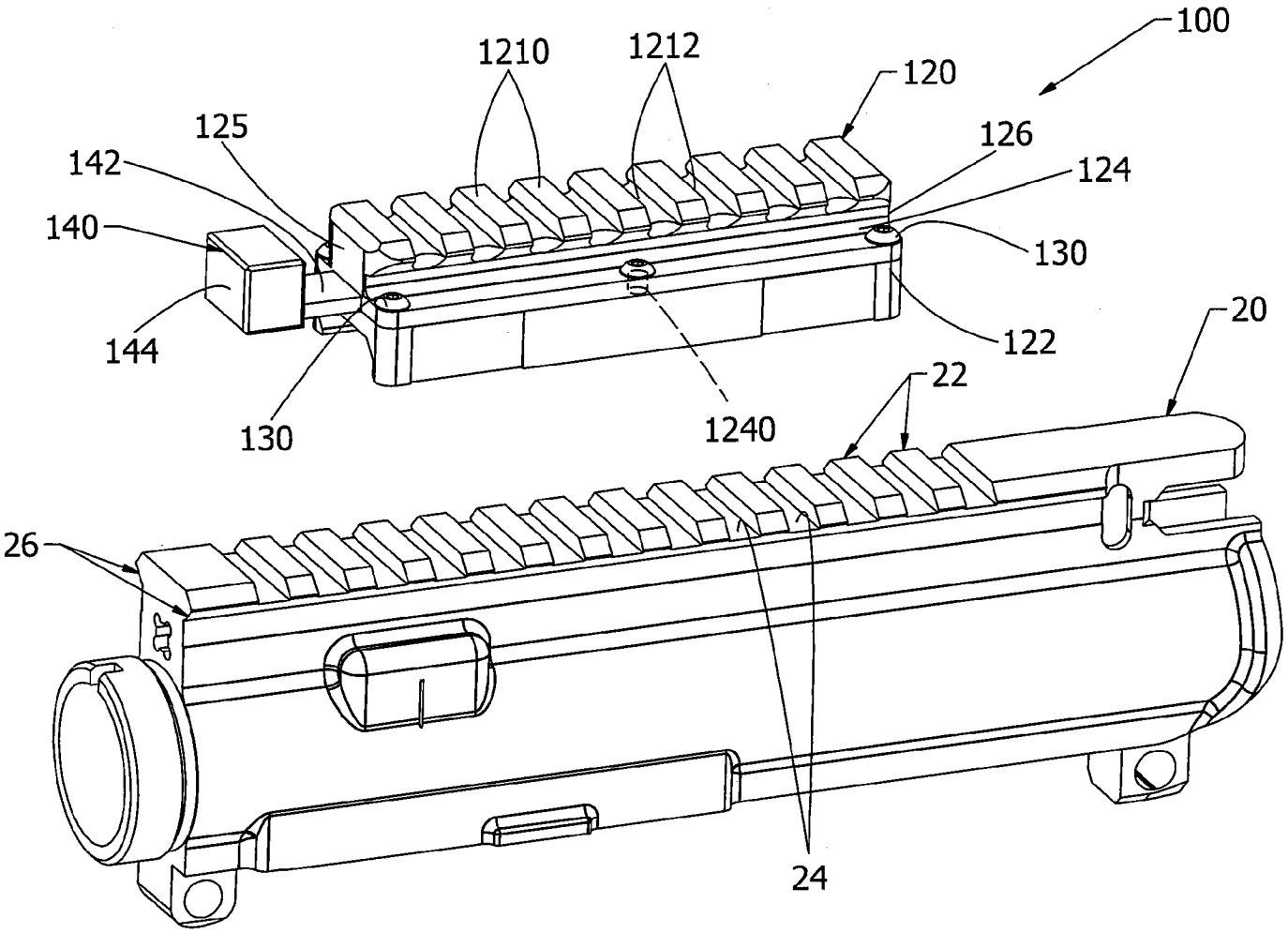
FIG. 2 is a perspective view of the device of the present invention detached from a Picatinny rail of a firearm.

Referring initially to the drawings, FIG. 1 depicts a perspective view of the side slide lock and quick release device 100 of the present invention securely attached to a Picatinny rail 20 of a firearm (not shown), and FIG. 2 depicts a perspective view of the device 100 of the present invention detached from Picatinny rail 20. By way of background, Picatinny rail 20 is an elongated bracket that may be attached to a firearm to provide a standard mounting platform for accessories and attachments such as a scope, light, bayonet and the like. Rail 20 is typically comprised of a plurality of raised, spaced apart lugs or ridges 22 along its top or upper surface, with channels 24 located between and formed by said ridges 22, and a rail flange 26 extending along each side of rail 20.

The side slide lock and quick release device 100 of the present invention is preferably comprised of a lower portion 110, an upper portion 120 removably attached to said lower portion 110 through the use of fasteners 130, and a locking mechanism 140 for detachably securing device 100 to rail 20 without the need for external tools. As best illustrated in the FIGS., lower portion 110 is an elongated member having a top surface 111, a bottom surface 112, opposing side surfaces 113, a rear 115, a front 116, a rear fence 117 and a forward fence 118, wherein said rear fence 117 and said forward fence 118 extend downwardly from said bottom surface 112 for mating engagement with rail 20, as described more fully below.

Lower portion 110 further comprises one or more continuous openings 1112 that extend between top surface 111 and bottom surface 112, and from a first side surface 113 in the direction of a second side surface 113, for receipt of a portion of locking mechanism 140, as described more fully below. Top surface 111 may also comprise a plurality of spaced apart openings 1114 for receipt of fasteners 130 to fixedly attach lower portion 110 to upper portion 120.

Figure 4B:
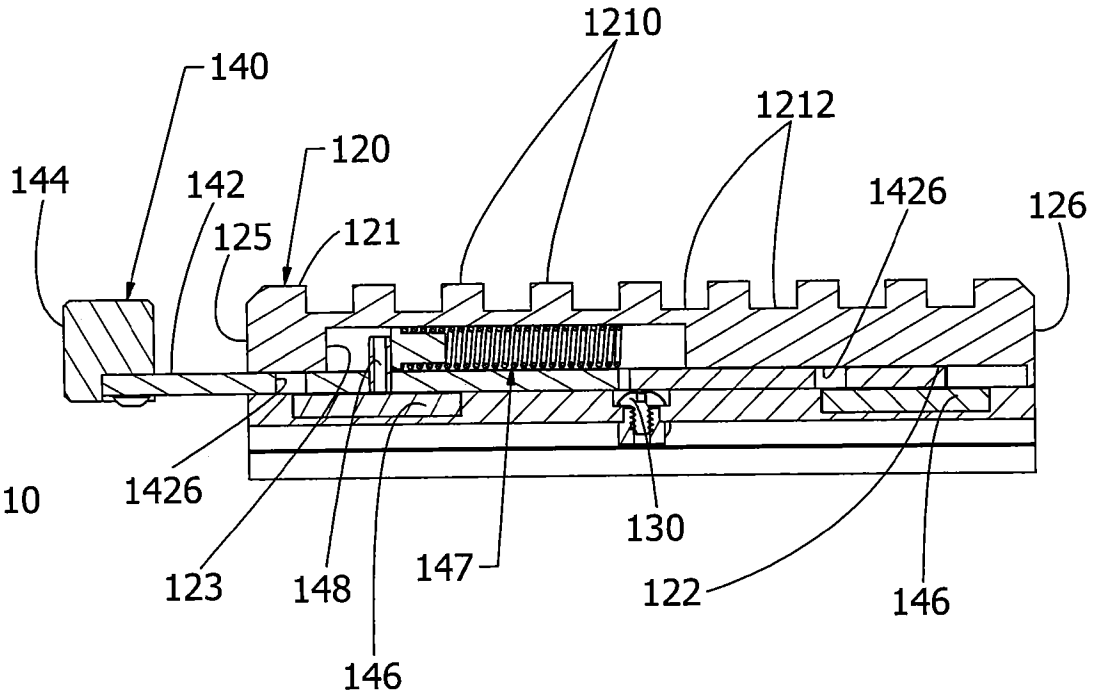
FIG. 4B is a cross-sectional view of the device depicted in FIG. 4A at cut line B-B.
Figure 4A:
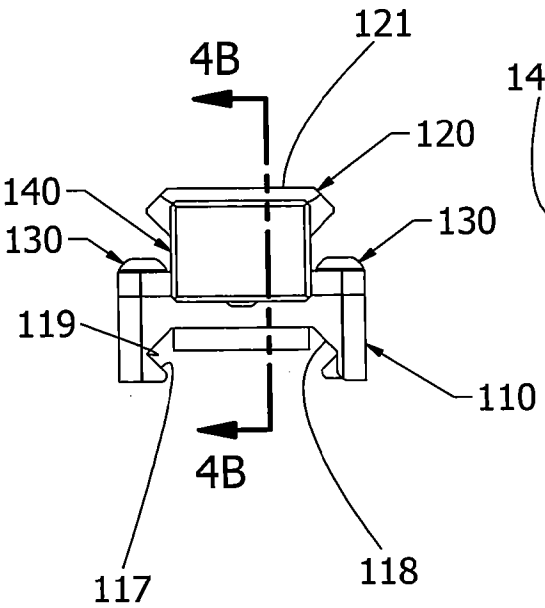
FIG. 4A is a front elevational view of the device of the present invention.
Figure 5:
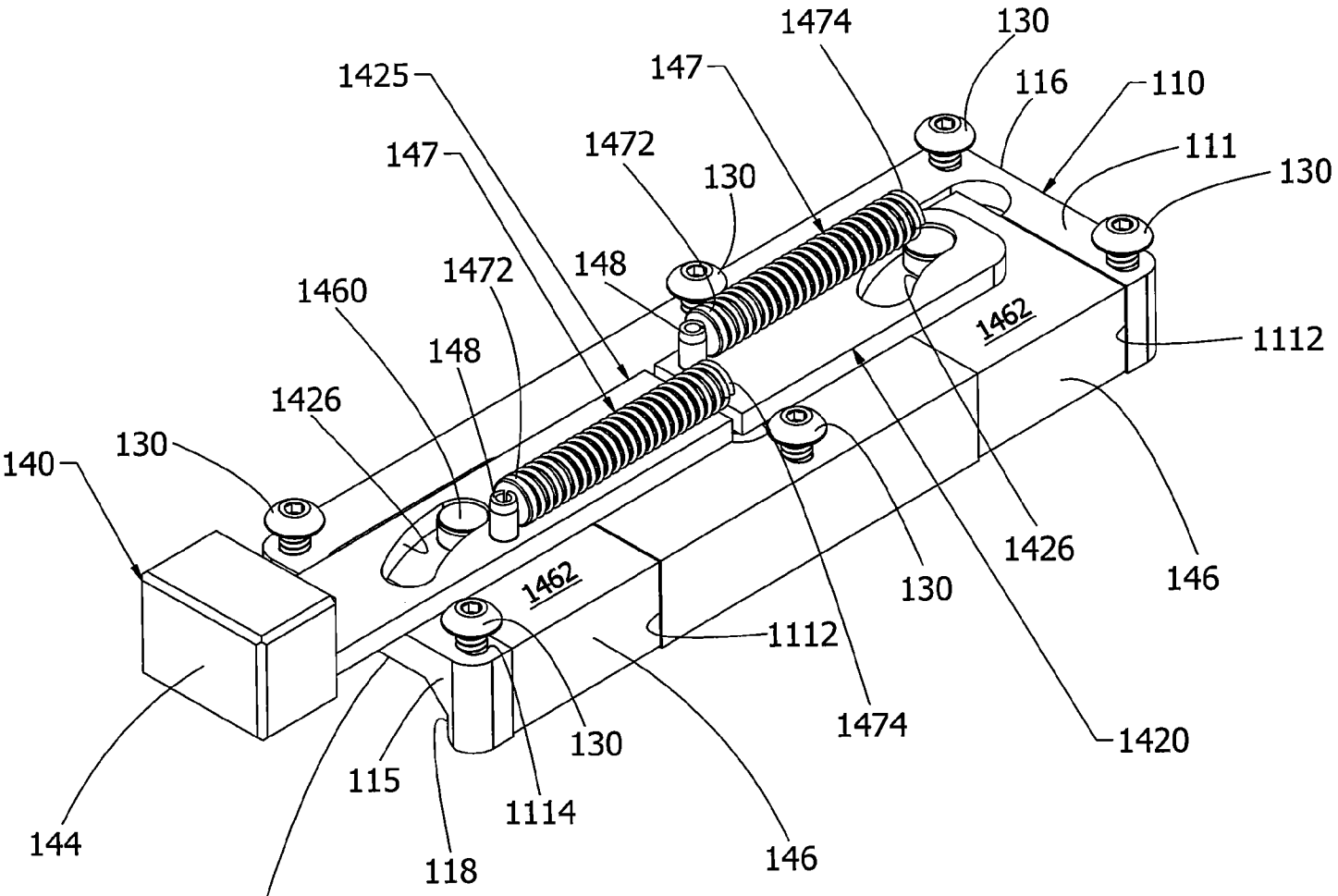
FIG. 5 is a perspective view of the lower portion and locking mechanism of the present invention.

As previously described, lower portion 110 is comprised of a pair of generally parallel, spaced apart fences 117, 118 that extend downwardly from said bottom surface 112 for mating engagement with rail 20. More specifically, rear fence 117 protrudes downwardly from one side of bottom surface 112 towards the front 116 of lower portion 110 and extends substantially along the length of lower portion 110. Similarly, forward fence 118 protrudes downwardly from the opposite side of bottom surface 112 towards the rear 115 of lower portion 110 and is generally parallel to rear fence 117, but that only extends partially along the length of lower portion 110, as best shown in FIG. 5, due to the presence of one or more continuous openings 1112. Rear fence 117 further comprise a generally v-shaped groove 119 extending along a substantial portion of the length of rear fence 117 for mating engagement with rail flange 26 of rail 20. Likewise, when locking mechanism 140 is engaged, forward fence 118 and a portion of locking mechanism 140 also form a generally v-shaped groove extending along a portion of the length of said forward fence 118 for mating engagement with rail flange 26 of rail 20, as best shown in FIG. 4A.

Upper portion 120 is also a generally elongated member that is comprised of a top 121, an opposing bottom 122, a pair of opposing side slots 124, a rear end 125 and a front end 126. Similar to Picatinny rail 20, top 121 is also comprised of a plurality of raised, spaced apart lugs or ridges 1210, with channels 1212 located between and formed by said ridges 1210.

Bottom 122 is generally flat and preferably corresponds in shape and size with top surface 111 of lower portion 110 as shown in the Figures, with the exception of (i) an elongated longitudinal opening or channel 1220 formed therein for receipt of a portion of locking mechanism 140 and (ii) one or more spring channels 123 formed therein for receipt of a spring, both of which are explained more fully below. Channel 1220 preferably extends along a partial length of bottom 122 from rear 115 in the direction of front 116. Each of said spring channel(s) 123 also preferably extends a partial length of bottom surface 122 to coincide with the positioning of springs, as described more fully below.

Figure 3A:
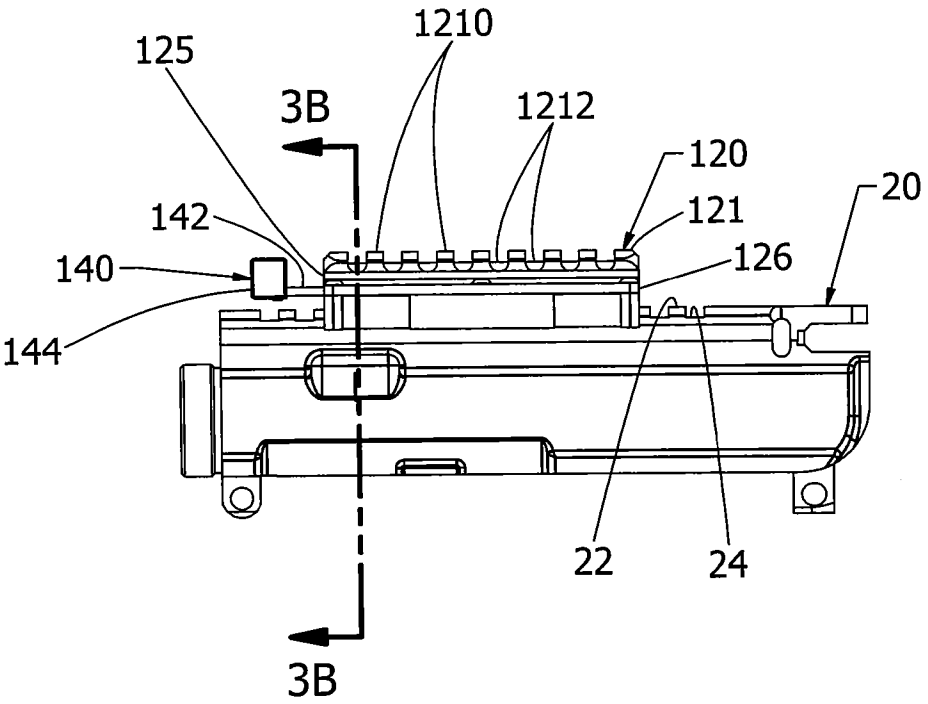
FIG. 3A is a side elevational view of the device of the present invention securely attached to a Picatinny rail of a firearm.
Figure 3B:
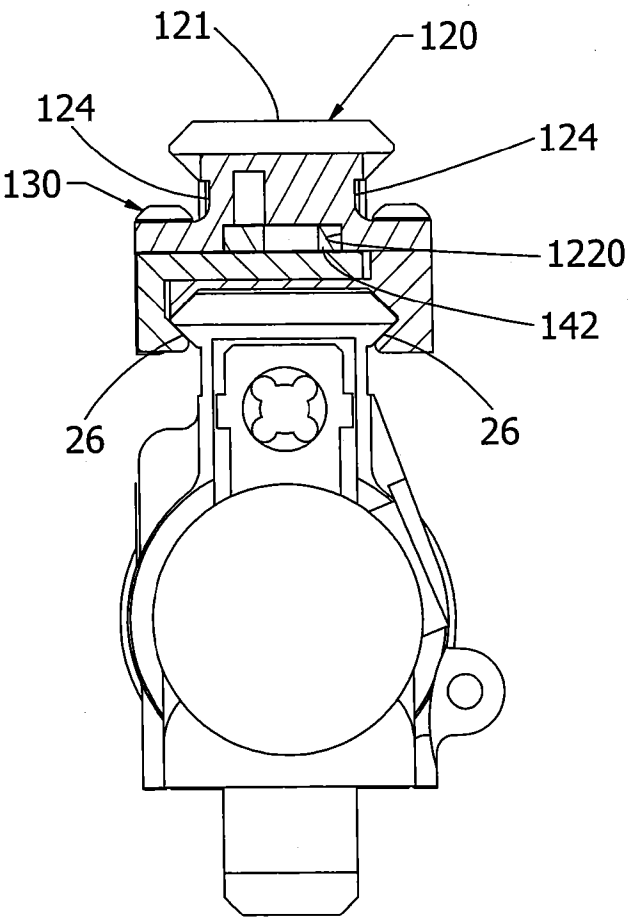
FIG. 3B is a cross-sectional view of the device depicted in FIG. 3A at cut line A-A.

Opposing side slots 124 are similar to rail flanges 26 in rail 20, and preferably extend between rear end 125 and front end 126 and are useful for attaching accessories (such as a scope, light, bayonet, etc.) to device 100 in generally the same manner that accessories (not shown) would ordinarily be attached to rail 20. Opposing side slots 124 may further comprise a plurality of spaced apart openings 1240 extending through bottom 122. The number and placement of openings 1240 preferably correspond to the number and placement of openings 1114 in lower portion 110 for receipt of fasteners 130, which are used to fixedly attach upper portion 120 to lower portion 110, as best shown in FIGS. 1-3.

Locking mechanism 140 is preferably comprised of an elongated arm portion 142, a handle portion 144 for engaging or dis-engaging locking mechanism 140, one or more locks 146 and one or more springs 147. In a preferred embodiment of the present invention, arm portion 142 is further comprised of a front latch 1420 and a rear latch 1425 positioned in series and sized to fit and slide longitudinally within channel 1220. Each of latches 1420, 1425 further comprise a radially shaped continuous opening 1426 therein for receipt of a cam, as explained more fully below and depicted in FIG. 5. Handle portion 144 may be attached to rear latch 1425 via fasteners 145.

Each of locks 146 are generally block-like in shape and further comprise a cam 1460 that extends upwardly from a top surface 1462 of lock 146, as best shown in FIG. 5. More specifically cam 1460 is positioned in opening 1426 of latches 1420, 1425 so that when said latches 1420, 1425 are repositioned longitudinally within channel 1220, cams 1460 cause each of locks 146 to move in and partially out of continuous openings 1112 in lower portion 110.

A spring 147 is positioned atop of each of front latch 1420 and rear latch 1425 as shown in FIG. 5 and secured to said latches via a spring post 148 and a spring pin 149. More specifically, each of springs 147 is comprised of a first end 1472 and a second end 1474, with said first end 1472 being fixedly attached to said spring post 148 via spring pin 149. Springs 147 are biased in the general direction of the length of device 100, as best shown in FIG. 5 and, when fully assembled, springs 147 are contained and confined within spring channels 123 of upper portion 120.

Figure 6:
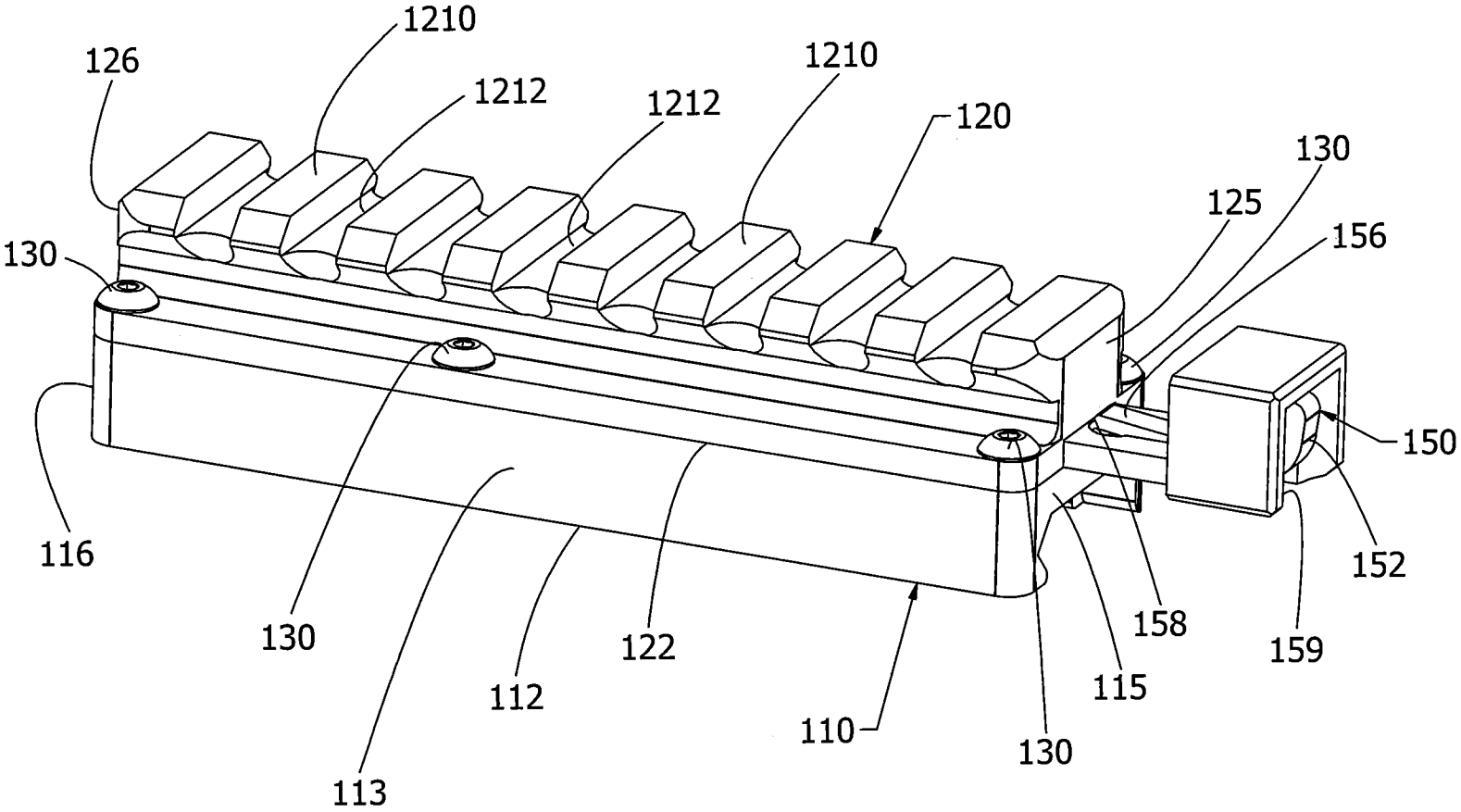
FIG. 6 is a perspective view of an alternative embodiment of the present invention wherein the locking mechanism further comprises a button lock to reduce the likelihood of an accidental release of the locking mechanism.
Figures 7A, 7B:
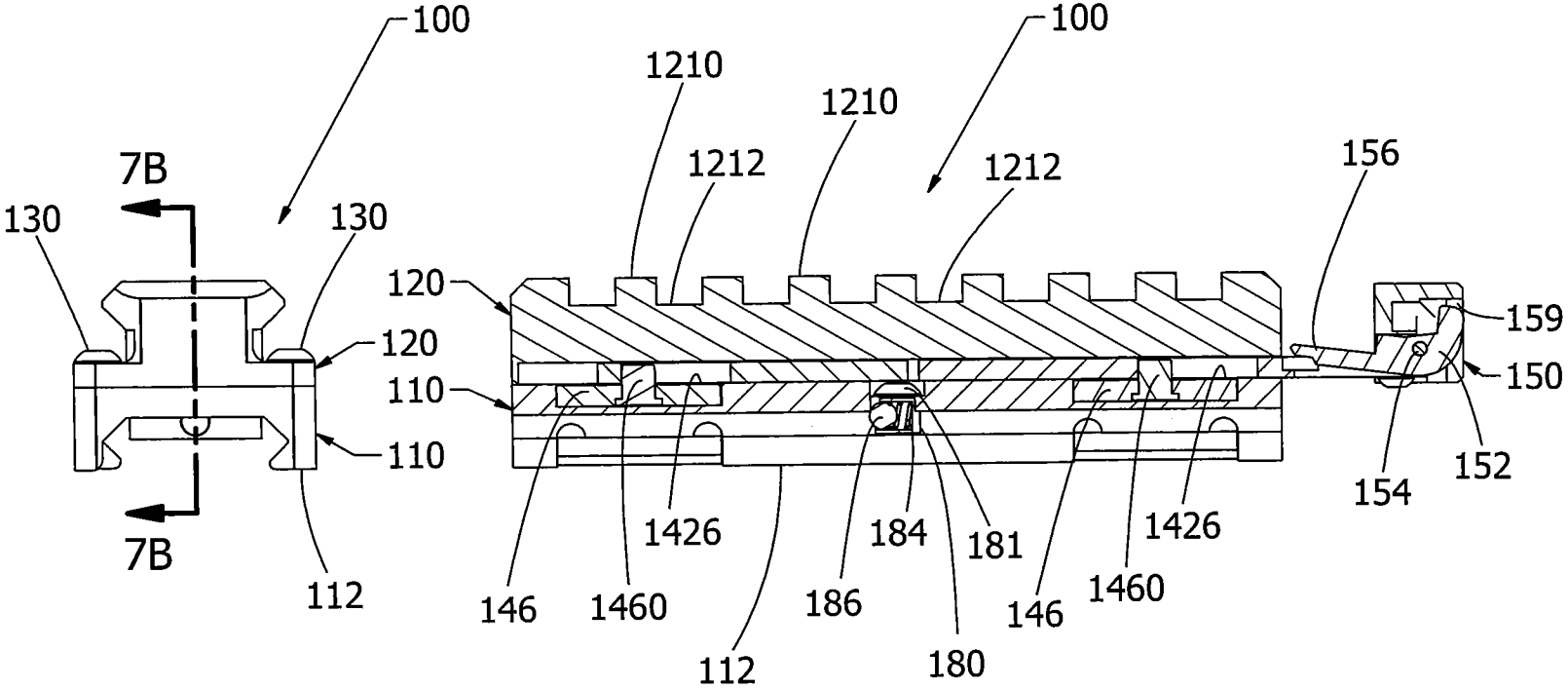
FIG. 7A is a rear elevational view of the alternative embodiment of the present invention depicted in FIG. 6.
FIG. 7B is a side cross-sectional view of the device depicted in FIG. 7A at cut line C-C.

In the further preferred embodiment of the present invention depicted in FIGS. 6, 7A and 7B, locking mechanism 140 further comprises a button lock 150 for reducing the likelihood of an accidental or premature release of locking mechanism 140. More specifically, button lock 150 comprises a button portion 152, a pin 154 and an arm 156, wherein button portion 152 and arm 156 are preferably integrally formed and pivot about pin 154. Button lock 150 is engaged/disengaged by partially rotating button portion 152 about pin 142, as described more fully below. Button portion 152 resides in a recess 159 in handle portion 144, as best shown in FIG. 6. When in the disengaged position, arm 156 resides in a recess 158 in arm portion 142. When in the engaged position, arm 142 extends outwardly from recess 158 to contact rear end 125 of upper portion 120 to prevent locking mechanism 140 from accidentally or prematurely releasing, as described more fully below.

Figure 8:
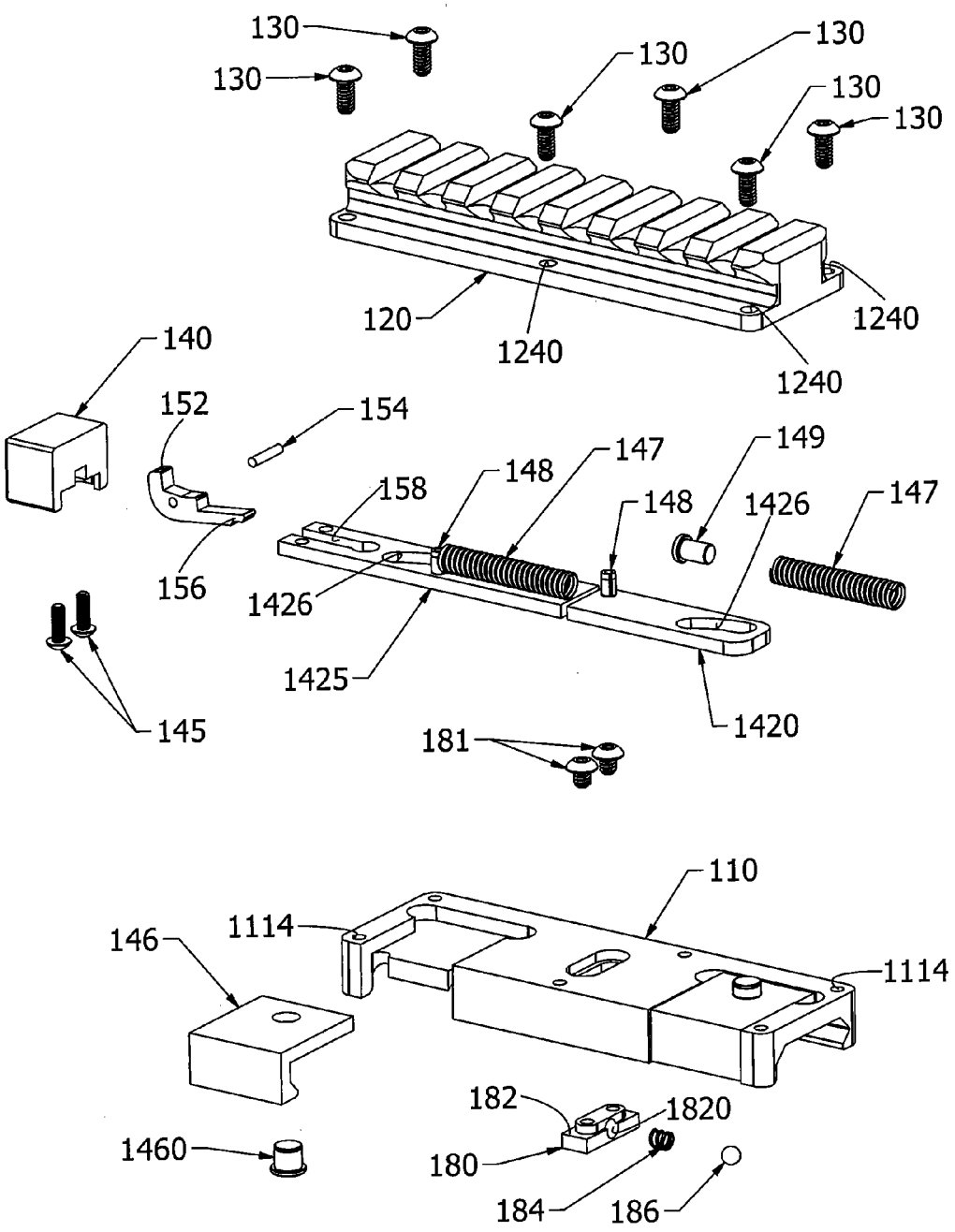
FIG. 8 is an exploded view of the alternative embodiment of the present invention depicted in FIG. 6.

For purposes of further clarity, FIG. 8 is an exploded view of the alternative embodiment of the present invention depicted in FIG. 6. As shown in FIG. 8, device 100 may further comprise an insert device 180 that may be secured to, and extend downwardly from, the bottom surface 112 of lower portion 110 with fasteners 181. Insert device 180 further comprises an insert portion 182 with an opening 1820 therein for receipt of a spring 184 and a ball 186. As more fully described below, insert device 180 is inserted into a select one of channels 24 of Picatinny rail 20 when device 100 is installed on rail 20, and biased spring 184 and ball 186 apply pressure against a select one of ridges 22 of rail 20.

Having now described the general structure of a preferred embodiment of device 100, its function will now be described in general terms. A user (not shown) desiring to securely mount device 100 onto rail 20 would simply place device 100 (in an unlocked position—meaning the handle portion 144 is pushed in towards device 100, as shown in FIGS. 1 and 2) at a desired position along and on top of rail 20 so that fences 117, 118 clear rail flanges 26 and locks 146 and insert device 180 are capable of being inserted into a respective select one of said channels 24. Once device 100 is placed on rail 20, the user would then release handle portion 144 (which is tensioned by springs 147) in a direction opposite of device 100, thereby causing cams 1460 to travel clockwise within radial openings 1426 and each of locks 146 to securely engage rail Picatinny 20. A user may then also desire to engage button lock 150 by partially rotating button portion 152 downwardly about pin 154 so that arm 156 extends upwardly from recess 158 to contact rear end 125 of upper portion 120 to prevent locking mechanism 140 from prematurely or accidentally disengaging.

Similarly, to unlock locking mechanism 140 to reposition device 100 along rail 20 or remove device 100 from rail 20 altogether, a user (not shown) would simply (i) disengage button lock 150 by partially rotating button portion 152 upwardly about pin 154 so that arm 156 retreats into recess 158 and (ii) push in handle portion 144 in the direction of device 100, thereby causing springs 147 to compress and cams 1460 to travel counter-clockwise within radial openings 1426 and each of locks 146 to disengage from Picatinny 20. More specifically, as the user pushes in handle portion 144 and rear latch 1425 moves forward along channel 1220 it makes contact with front latch 1420 and causes the same to also move forward, thereby causing each of springs 147 to compress and the device 100 to become capable of being installed or removed from rail 20. Once the device 100 has been installed, the compression force in the springs 147 causes each of front latch 1420 and rear latch 1425 to retreat to their original position.

Other variations are also within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A device for enabling a user to detachably mount an accessory on a Picatinny rail of a firearm device comprising:

a lower portion;

an upper portion;

a longitudinal channel; and a locking mechanism, wherein said locking mechanism comprises a first latch having a first elongate length positioned in series with a second latch having a second elongate length in said longitudinal channel such that said first and second elongate lengths extend longitudinally in said longitudinal channel.

2. The device of claim 1 wherein said locking mechanism further comprises a handle portion, a spring, and a lock.

3. The device of claim 2 wherein said locking mechanism further comprises a cam, and further wherein said spring is attached to one of said first latch and said second latch.

4. The device of claim 2 wherein said lock is repositioned when at least one of said first latch and said second latch is repositioned.

5. The device of claim 1 wherein said locking mechanism further comprises a handle portion, a first spring attached to said first latch, a second spring attached to said second latch, a first cam, a second cam, a first lock and a second lock.

6. The device of claim 5 wherein said first lock is repositioned by moving said first latch and said second lock is repositioned by moving said second latch.

7. The device of claim 5 wherein said first lock is repositioned by moving said first latch and said first cam, and further wherein said second lock is repositioned by moving said second latch and said second cam.

8. The device of claim 6 further comprising a button lock comprised of a button portion, an arm and a pin, wherein said button portion and said arm pivot on said pin.

9. The device of claim 7 further comprising a button lock comprised of a button portion, an arm and a pin, wherein said button portion and said arm pivot on said pin.

10. A device for enabling a user to detachably mount an accessory on a firearm device comprising:

a lower portion comprised of a rear fence and a forward fence;

an upper portion comprised of a first spring channel, a second spring channel and a plurality of ridges and channels, wherein said upper portion is attached to said lower portion;

a longitudinal channel; and a locking mechanism, wherein said locking mechanism comprises a first latch having a first elongate length positioned in series with a second latch having a second elongate length in said longitudinal channel such that said first and second elongate lengths extend longitudinally in said longitudinal channel.

11. The device of claim 10 wherein said locking mechanism further comprises a handle portion, a first spring attached to said first latch, a second spring attached to said second latch, a first cam, a second cam, a first lock and a second lock.

12. The device of claim 11 wherein said first lock is repositioned by a movement of said first latch and said second lock is repositioned by a movement of said second latch.

13. The device of claim 11 wherein said first lock is repositioned by a movement of said first latch and said first cam, and further wherein said second lock is repositioned by a movement of said second latch and said second cam.

14. The device of claim 11 wherein said first spring is positioned in said first spring channel and said second spring is positioned in said second spring channel.

15. The device of claim 12 wherein the repositioning of the first lock is substantially perpendicular to the movement of the first latch, and further wherein the repositioning of the second lock is substantially perpendicular to the movement of the second latch.

* * * * *